US007337612B2

(12) United States Patent
Skinnes et al.

(10) Patent No.: US 7,337,612 B2
(45) Date of Patent: Mar. 4, 2008

(54) METHOD FOR THE UTILIZATION OF ENERGY FROM CYCLIC THERMOCHEMICAL PROCESSES TO PRODUCE MECHANICAL ENERGY AND PLANT FOR THIS PURPOSE

(75) Inventors: Bjørn Skinnes, Kongsberg (NO); Gennady Barchan, Kongsberg (NO)

(73) Assignee: Geba AS, Kongsberg (NO)

( * ) Notice: Subject to any disclaimer, the term of this patent is extended or adjusted under 35 U.S.C. 154(b) by 249 days.

(21) Appl. No.: 10/512,400

(22) PCT Filed: Apr. 23, 2003

(86) PCT No.: PCT/NO03/00133

§ 371 (c)(1),
(2), (4) Date: Oct. 22, 2004

(87) PCT Pub. No.: WO03/091549

PCT Pub. Date: Nov. 6, 2003

(65) Prior Publication Data

US 2005/0178125 A1 Aug. 18, 2005

(30) Foreign Application Priority Data

Apr. 24, 2002 (NO) ..... 20021941
Apr. 22, 2003 (NO) ..... 20031789

(51) Int. Cl.
*F01K 25/08* (2006.01)

(52) U.S. Cl. ..... 60/651; 60/671

(58) Field of Classification Search ..... 60/645, 60/651, 671

See application file for complete search history.

(56) References Cited

U.S. PATENT DOCUMENTS

| | | | | |
|---|---|---|---|---|
| 2,966,397 | A | 12/1960 | Darbee et al. | |
| 3,677,239 | A | 7/1972 | Elkins | |
| 3,712,281 | A | 1/1973 | Ruth | |
| 3,844,262 | A | 10/1974 | Dieges | |
| 3,861,148 | A | 1/1975 | Bailey et al. | |
| 4,578,943 | A | 4/1986 | Scampini | |
| 4,587,807 | A | 5/1986 | Suzuki | |
| 5,016,599 | A | 5/1991 | Jubb | |
| 5,121,606 | A | 6/1992 | Schukey | |
| 5,477,672 | A * | 12/1995 | Tsujikado et al. | 60/39.462 |
| 5,727,368 | A * | 3/1998 | Wernimont et al. | 60/218 |
| 6,527,980 | B1 * | 3/2003 | Roden et al. | 252/373 |

FOREIGN PATENT DOCUMENTS

| | | |
|---|---|---|
| DE | 355866 | 9/1916 |
| DE | 460030 | 2/1926 |
| DE | 2 228 949 | 6/1972 |
| DE | 32 28 082 A1 | 12/1983 |
| DE | 179826 | 3/2005 |
| DE | 179771 | 6/2005 |
| EP | 0 340 545 | 11/1989 |
| FI | 885 535 | 11/1988 |
| FR | 2 776 018 | 9/1999 |
| GB | 1 328 932 | 9/1973 |
| SE | 375 582 | 4/1975 |
| SE | 395 932 | 8/1977 |

* cited by examiner

*Primary Examiner*—Hoang Nguyen
(74) *Attorney, Agent, or Firm*—Finnegan, Henderson, Farabow, Garrett & Dunner, L.L.P.

(57) ABSTRACT

There is described a method for operation of a traditional engine or turbine, where instead of a combustion reactor there are utilized cyclic thermochemical processes that drive the engine or turbine without the formation of waste gases that are harmful to the environment.

15 Claims, 5 Drawing Sheets

METHOD FOR THE UTILIZATION OF ENERGY FROM CYCLIC THERMOCHEMICAL PROCESSES TO PRODUCE MECHANICAL ENERGY AND PLANT FOR THIS PURPOSE

The present invention relates to the utilization of energy from cyclic thermochemical processes in common motors and turbines, and to specific processes for use in motors and/or turbines under various exterior conditions. More specifically the invention relates to a method for production of mechanical energy from an energy producing unit such as a turbine, rotor piston engine and piston engine or the like, comprising feeding an input fluid to the energy producing unit, where the input fluid before entering or within the unit undergoes a thermochemical reaction and/or phase change causing a volume expansion of the fluid, which volume expansion drives the energy producing unit.

Cyclic thermochemical processes are used today in the chemical processing industry, inter alia in adsorption-desorption, in the production of hydrogen (see McAuliffe Ch. A. "Hydrogen and energy" L. 1980) and in biochemistry in the ornithine cycle and the like. Energy and products from these processes are not used, however, as actuating fluid in energy producing equipment such as turbines and rotor and piston engines.

Until now turbines and rotor and piston engines have often been used in or in connection with combustion engines, where the actuating fluid consists of hydrocarbons. The hydrocarbons undergo an oxidation process that develops heat and/or produces a volume increase. On combustion there are formed waste gases, which constitute an environmental problem.

For combustion engines various apparatuses and methods are known for the recycling of portions of the waste gases from the combustion process. Such methods are described, inter alia, in EP 340545, U.S. Pat. No. 5,016,599, U.S. Pat. No. 3,677,239, U.S. Pat. No. 3,712,281 and U.S. Pat. No. 4,587,807. These processes use traditional actuating fluids that go through a course of combustion in the engines.

The purpose of the present invention is to utilize cyclic thermochemical processes and phase changes in common combustion engines or turbines so that these can be driven without a combustion process taking place and with associated recycling/regeneration of the actuating fluid so as to avoid the formation of waste gases harmful to the environment.

A further objective of the invention is to utilize concrete actuating fluids in cyclic thermochemical processes in turbines and/or engines.

The present invention provides a method for operation of a unit that produces mechanical energy such as a turbine, rotor piston engine and piston engine, or the like. The invention is distinguished by the characteristic features cited in claim 1, 12-14 and 16. Further the invention provides a plant for performing the method according to the invention.

Additional features pertaining to preferred embodiment forms of the invention are described in the dependent claims.

Figure 1:
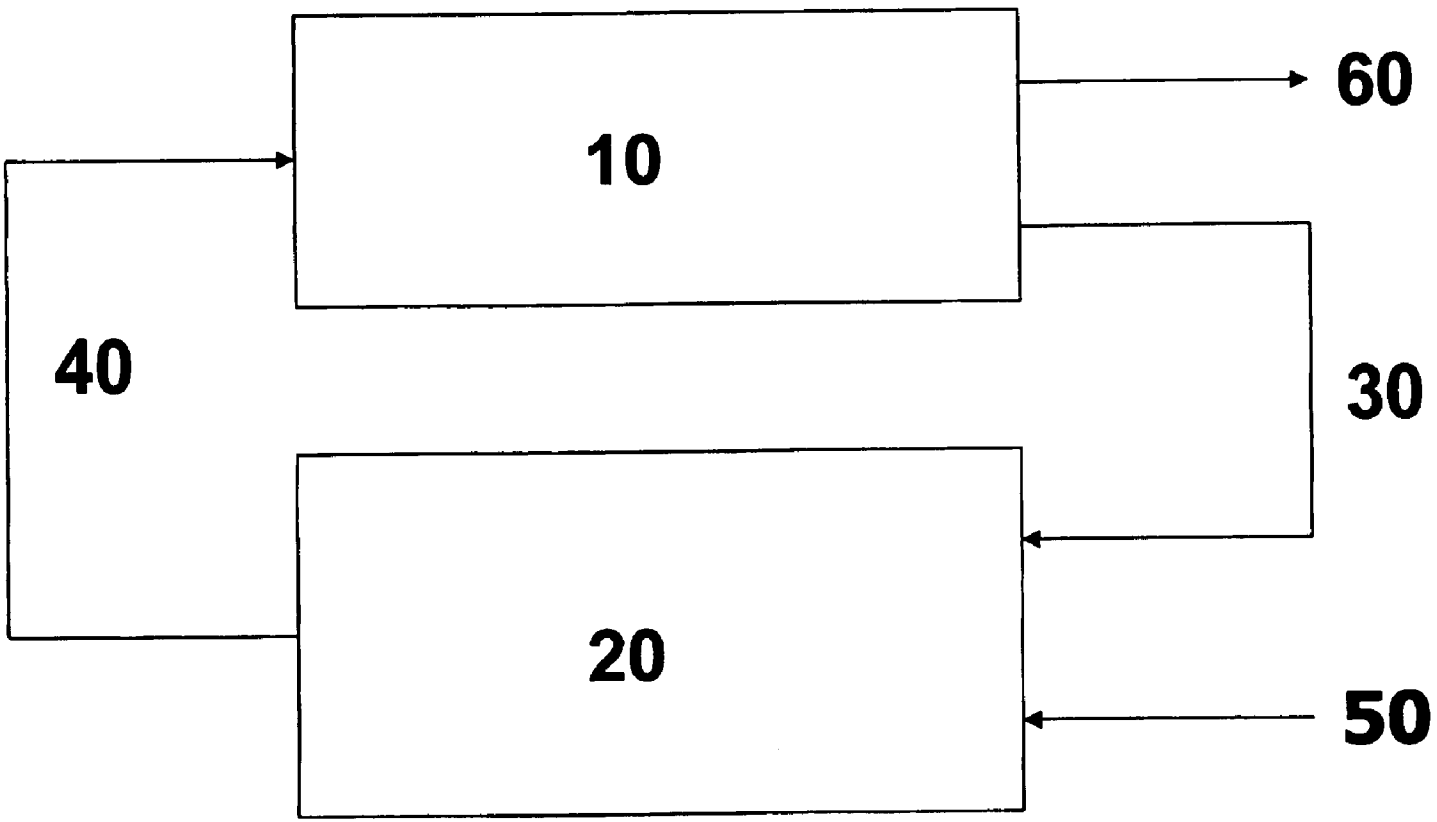
Figure 2:
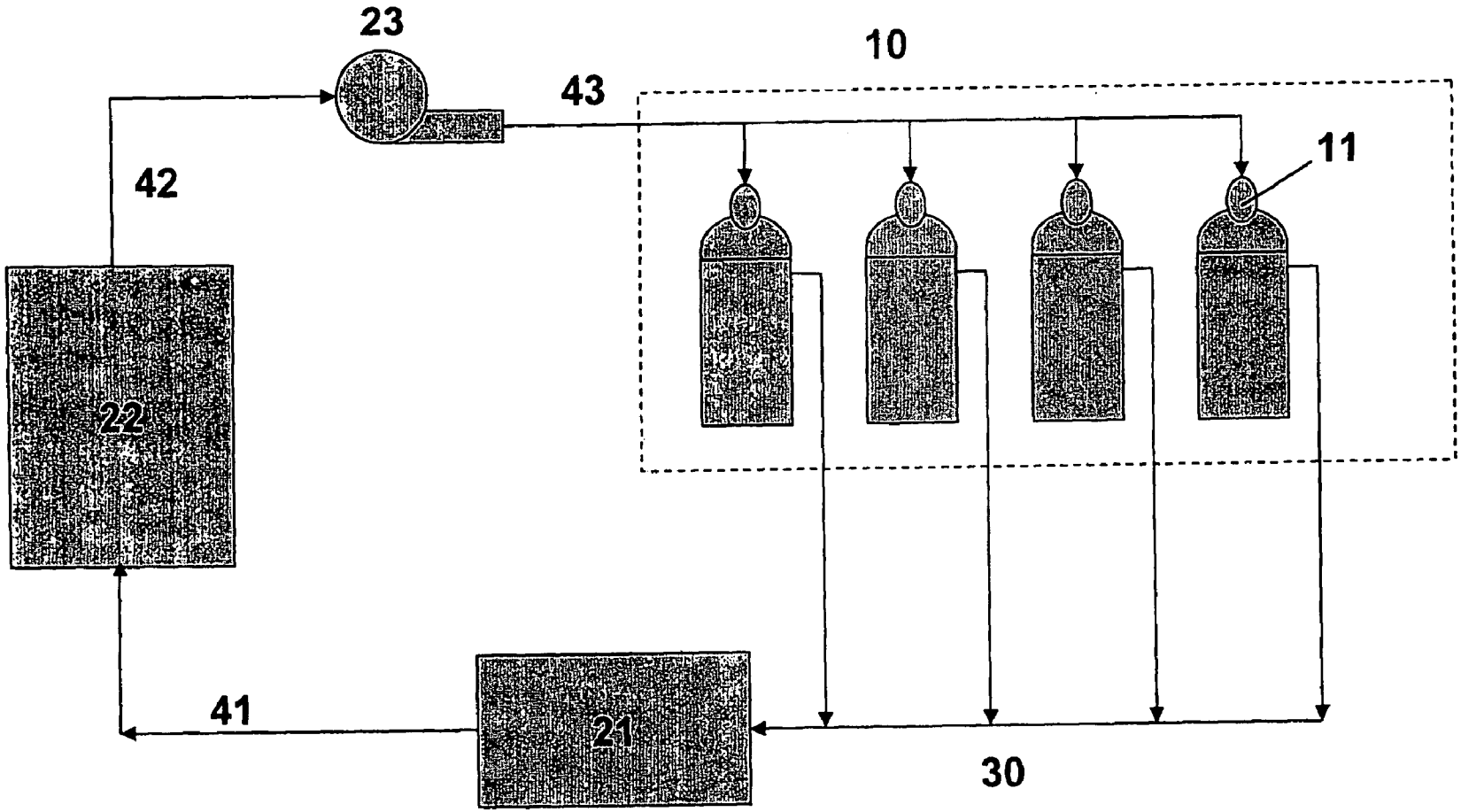
Figure 3:
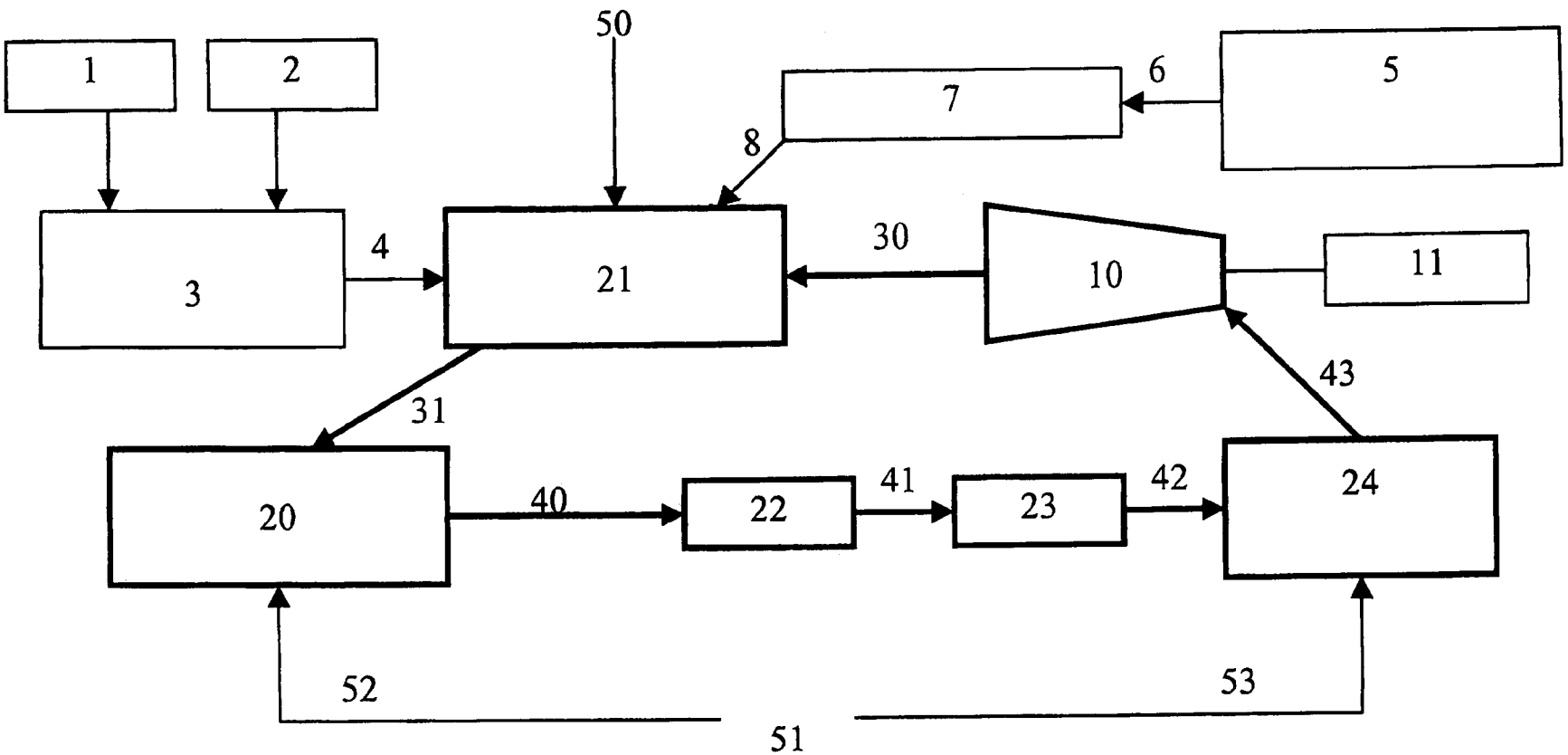
Figure 4:
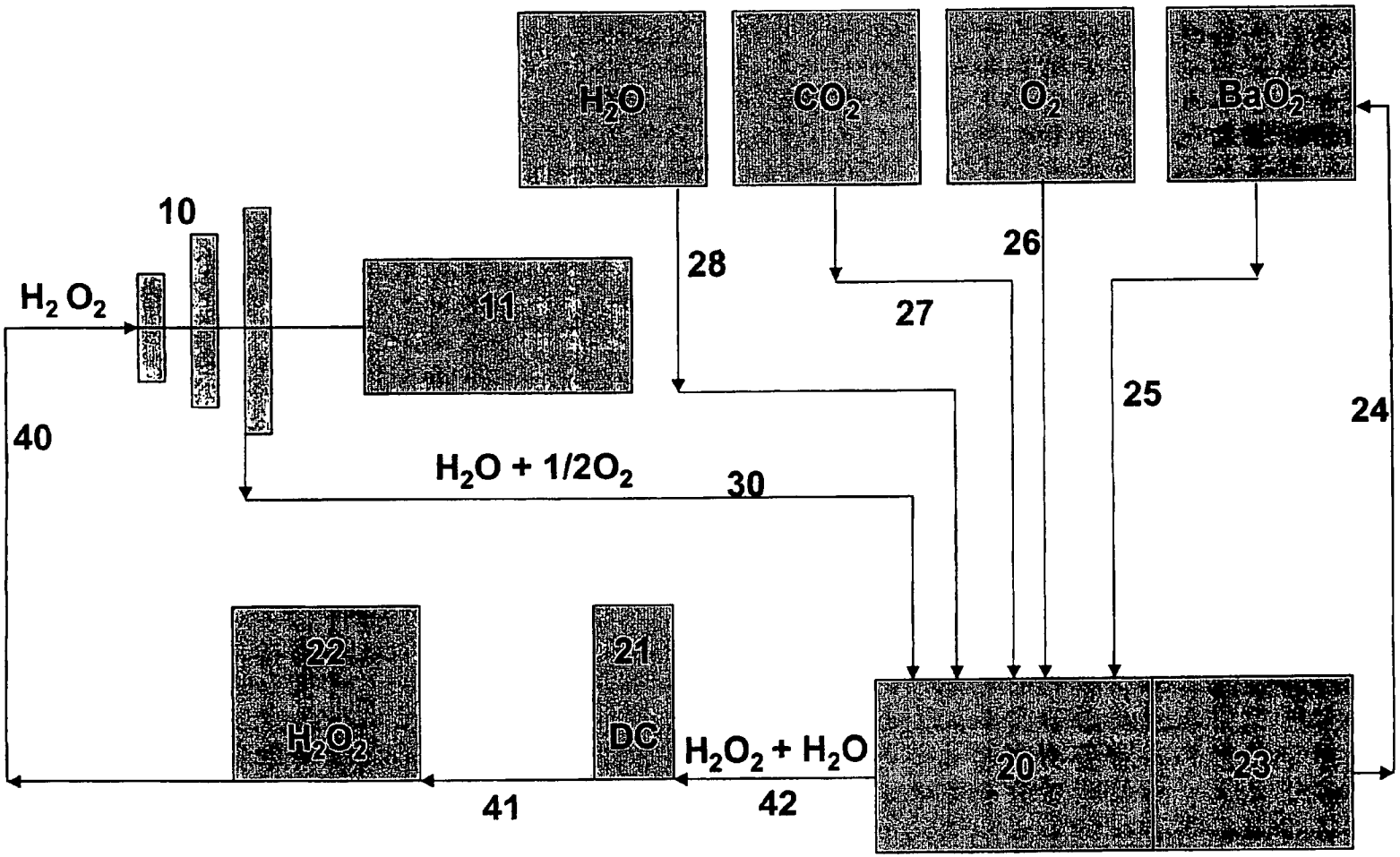
Figure 5:
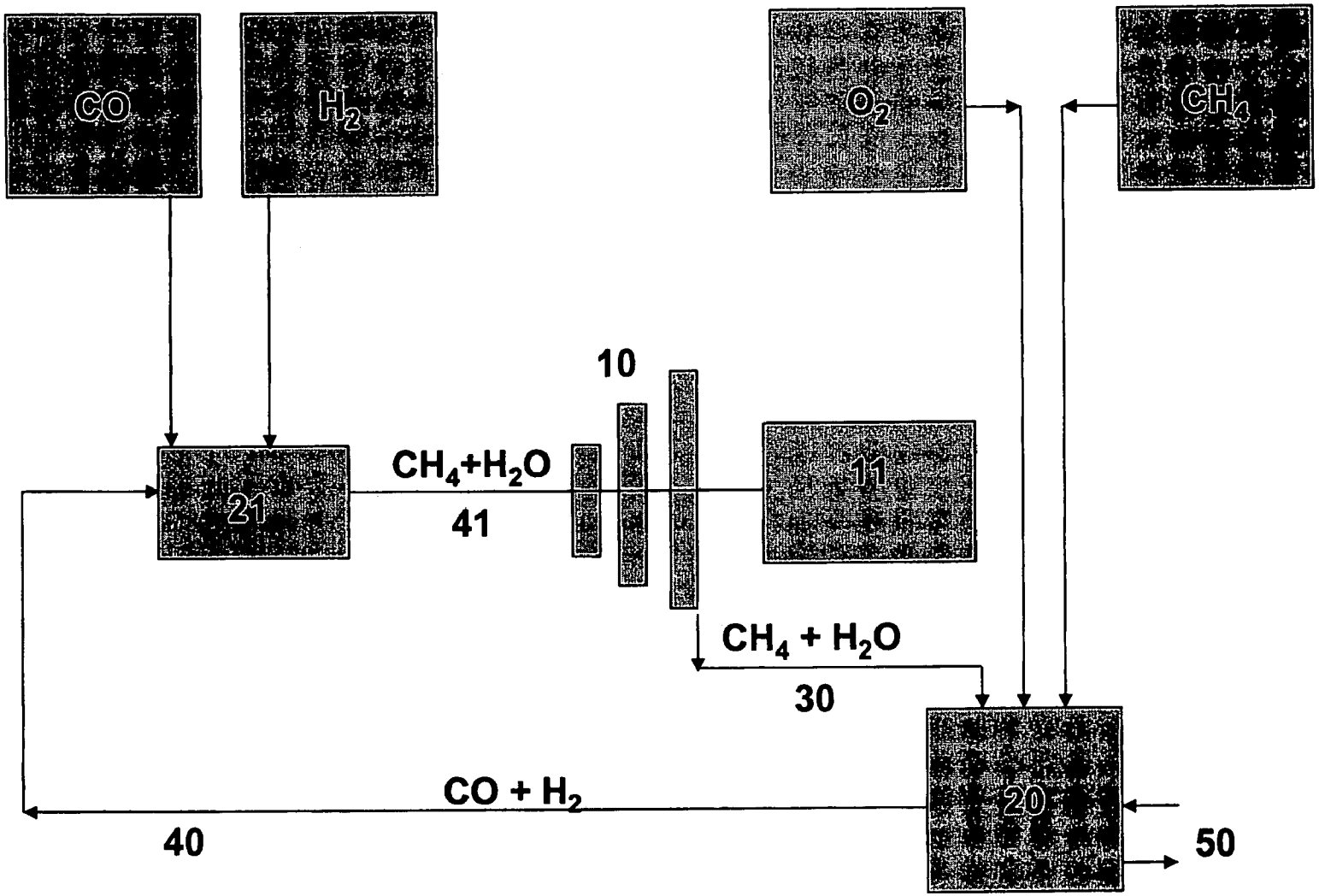

Some possible embodiment forms of the invention are shown on the accompanying figures, where FIG. 1 illustrates the underlying principle of the invention, FIG. 2 shows an embodiment form with water as the actuating fluid, FIG. 3 illustrates the principle of a gas hydrate plant, FIG. 4 shows an embodiment form with hydrogen peroxide as actuating fluid, and FIG. 5 shows an embodiment form with carbon monoxide and hydrogen as actuating fluid.

FIG. 1 illustrates the fundamental principle of the invention. Mechanical energy 60 is generated in a piston engine/turbine 10 by feeding a stream 40 of actuating fluid into it from a chemical reactor 20, where a dissociation process or other chemical reaction takes place which results in a direct and/or an indirect volume increase. By indirect volume increase is meant a volume increase that is due to heat generation as a result of an exothermic reaction. The outlet stream 30 from the piston engine/turbine 10 is fed back to the chemical reactor 20, where it is regenerated by means of external energy source substances 50. The invention does not include common combustion reactions, since what are involved here are cyclical thermochemical processes where the actuating fluid that is fed into the engine/turbine is regenerated.

Power plants that are based on the method according to the invention and other types of power sources may be structurally combined into integrated energy units. The type of such power sources will depend on the natural and industrial resources that are available.

The basic idea of the invention is a technology for utilizing energy and/or the dissociation products from various compounds, obtained as a result of a cyclic thermochemical process or phase change, for engine work, whereby the compounds and their dissociation products, which constitute at least a portion of the actuating fluid that is fed to the engine 10, after having carried out their work, undergo a total or partial conversion or regeneration to the compounds initially used without releasing waste gases into the environment.

A great number of different substances can be used as actuating fluid in the method according to the invention, for example, water, aqueous solutions of various compounds including gases and other low-boiling fluids, clathrates and also cold embedded compounds (including metal hydrides [for example, $MgH_2$] and gas hydrates of various gases or gas mixtures), hydrogen peroxide, hydrogen, hydrocarbon and carbonaceous gases capable of conversion (for example, steam and steam-oxygen conversion of methane, ethylene, acetylene, CO, $CO_2$, etc.). There are several thousand such substances known. Some typical reactions by which the method can be realized are shown below.

| | |
|---|---|
| $CO + 3H_2 \leftrightarrow CH_4 + H_2O$ | $C_2H_4 + H_2 \leftrightarrow C_2H_6$ |
| $CO_2 + 4H_2 \leftrightarrow CH_4 + 2H_2O$ | $C_{10}H_8 + 5H_2 \leftrightarrow C_{10}H_{18}$ |
| $CO_2 + H_2 \leftrightarrow CO + H_2O$ | $—CH_2— + H_2O \leftrightarrow CO + 2H_2$ |
| $CO + H_2 \leftrightarrow ½CH_4 + ½CO_2$ | $C_2H_4 + HCl \leftrightarrow C_2H_5Cl$ |
| $CO + H_2O \leftrightarrow CO_2 + H_2$ | $CO + Cl \leftrightarrow COCl$ |
| $2CO + 2H_2 \leftrightarrow CH_4 + CO_2$ | $—CH_2— + ½O_2 \leftrightarrow CO + H_2$ |
| $CH_4 + 2O_2 \leftrightarrow CO_2 + 2H_2O$ | $SO_3 + H_2O \leftrightarrow H_2SO_4$ |
| $CH_4 + ½O_2 \leftrightarrow CO + 2H_2$ | $H_2O + H_2SO_4 \leftrightarrow H_2SO_4.H_2O$ |
| $CH_4 + O_2 \leftrightarrow CO_2 + 2H_2$ | |

To carry out the method according to the invention a number of different gas hydrates may be used, as mentioned above. In Table 1 are shown a number of hydrate-forming substances and some of the physical properties of the hydrates obtained. In this context the chemical breakdown is referred to as decomposition.

TABLE 1

Formation energy, decomposition temperatures and decomposition pressures for some gas hydrates

| Hydrate former | Boiling point ° C. | Hydrate: Structural type | Mole quantity $H_2O$: Estimated | Mole quantity $H_2O$: Obtained | Formation energy, kJ/mole | Decomposition temperature at 1 atm, ° C. | Decomposition pressure at 0° C., MPa |
|---|---|---|---|---|---|---|---|
| Ar | −186 | Type I | 5¾ | ~6 | 55.4 | −42.8 | 10.5 |
| $CH_4$ | −164 | Type I | 5¾ | ~6 | 60.7 | −29.0 | 2.6 |
| Kr | −153 | Type I | 5¾ | 5.7 | 58.2 | −27.8 | 1.45 |
| $CF_4$ | −128 | Type I | 5¾ | — | — | — | — |
| Xe | −107 | Type I | 5¾ | ~6 | 69.9 | −3.4 | 0.15 |
| $C_2H_4$ | −104 | Type I | 5¾ | ~6 | 64.0 | −13.4 | 0.55 |
| $N_2O$ | −89 | Type I | 5¾ | ~6 | 62.0 | −19.3 | 1.0 |
| $C_2H_6$ | −88 | Type I | 5¾ | 5.8 ± 0.5 | 62.8 | −15.8 | 0.52 |
| $PH_3$ | −87 | Type I | 5¾ | 5.9 | 68.7 | −6.4 | 0.16 |
| $C_2H_2$ | −84 | Type I | 5¾ | 5.7 | 63.6 | −15.4 | 0.57 |
| $CO_2$ | −79 | Type I | 5¾ | ~6 | 61.1 | −24.0 | 1.23 |
| $CH_3F$ | −78 | Type I | 5¾ | ~6 | — | — | 0.23 |
| $H_2S$ | −61 | Type I | 5¾ | 5.7 | 68.2 | +0.35 | 0.10 |
| $AsH_3$ | −55 | Type I | 5¾ | — | — | +1.8 | 0.08 |
| $C_3H_8$ | −45 | Type I | 5¾ | — | — | 0.0 | 0.10 |
| $H_2Se$ | −42 | Type I | 5¾ | 5.9 | 70.3 | +8.0 | 0.05 |
| $Cl_2$ | −34 | Type I | 5¾ | 5.9 ± 0.3 | 67.8 | +9.6 | 0.03 |
| $C_2H_5F$ | −32 | Type I | 5¾ | ~6 | 84.1 | +3.7 | 0.07 |
| $CH_3Cl$ | −24 | Type I | 5¾ | ~6 | 75.8 | +7.5 | 0.04 |
| $SO_2$ | −10 | Type I | 5¾ | 6.1+0.6 | 69.5 | +7.0 | 0.04 |
| $CH_3Br$ | +4 | Type I | 7⅔ | ~8 | 81.6 | +11.1 | 0.02 |
| $ClO_2$ | +10 | Type I | 7⅔ | ~8 | — | +15.0 | 0.02 |
| $C_2H_5Cl$ | +13 | Type II | 17 | ~16 | 113.6 | — | 0.03 |
| $C_2H_5Br$ | +38 | Type II | 17 | — | — | — | 0.02 |
| $CH_2Cl_2$ | +42 | Type II | 17 | — | 121.4 | — | 0.02 |
| $CH_3I$ | +43 | Type II | 17 | 17 | 131.5 | — | 0.01 |
| $CH_3CHCl_2$ | +57 | Type II | 17 | — | — | — | 0.01 |
| $Br_2$ | +59 | Type I | 7⅔ | 7.9 ± 0.5 | 82.1 | — | 0.01 |
| $CHCl_3$ | +61 | Type II | 17 | — | 125.6 | — | 0.01 |

Formation energy refers to the reaction of 1 mole of gaseous hydrate-forming substance with liquid water at a temperature of 0° C.

The following examples are intended to illustrate the invention more fully without limiting it. The examples show the use of various types of thermochemical actuating fluids and possible conditions that enhance their applicability.

EXAMPLE 1

Finely-Divided Water

This method may be used in steam and gas turbines, piston engines or rotor-piston engines. There are many different constructional solutions for their design, for example: adiabatic or diesel engines, reactive turbines (Segner's wheel), turbines constructed for radial-flow and mixed-flow, rotor engines and Sterling engines.

The operation of power source 10 is illustrated schematically in FIG. 2. Water (fuel) from a water tank 22 is conducted through a pipeline 42 into an activator 23, in this embodiment form a high pressure pump/electromagnetic dissociation device. The activated and finely-dispersed water that is obtained is conducted through line 43 and sprayed through one or more nozzles 11 into the engine/turbine 10. In the illustrated version the energy producing unit is shown—for example—as a piston engine. When the water comes into contact with a heated surface inside the engine or is brought into contact with hot compressed gas, the water is immediately converted to steam or a steam-gas mixture. The volume of the steam or steam-gas mixture will exceed the volume of the activated and finely-dispersed water by a magnitude of $1.3\cdot10^3$-$9\cdot10^3$ times. This volume increase will drive the pistons. When the pistons descend, the inlet ports or valves are opened and the steam or steam-gas mixture is conducted through line 30 into a condenser 21 formed as an expansion chamber. Here the pressure decreases sharply and the steam is condensed into fluid. The fluid is passed through line 41 back to the water tank 22. Between condenser 12 and water tank 22 there may optionally be provided a separator, which ensures that the water conducted back to the tank 22 has the proper purity.

Up to 10% of the energy released through the process is used in the piston engine and to activate and disperse the water. This depends on the dissociation method. Partial dissociation allows to vary widely the process parameters and engines energy capacity.

The water is activated during the process of non-equilibrium dissociation, and the following compounds, inter alia, are formed: $H_2$, H, $H^+$, $H^-$, $HO_2^+$, OH, $OH^+$, $OH^-$, O, $O_2$, $O^+$, $O^-$, $O_2^+$, $H_2O$. The quantity and the composition of the formed compounds is completely dependent on the type of the activators used and the parameters of the water dissociation method. During full water dissociation the following compounds are formed:

$$H_2O \rightarrow 0.1666\ O^+ + 0.1666\ O^- + 0.0002\ H_2 30\ 0.0001\ OH^+ + +0.0001\ OH^- + 0.3332\ H^+ + 0.3332\ H^-$$

Accordingly, in this context, by activation is meant a chemical activation of the actuating fluid, whereby a portion of the actuating fluid molecule is rendered more reactive.

The energy of the process is the sum of the steam expansion energy and the chemical energy of the activated compounds:

$$E=E_w+E_h+E_d$$

wherein

E represents the energy of the process (steam expansion, activated compounds).

$E_w$ represents the energy provided by the motor, $E_h$ represents the energy used for heating and activating, $E_d$ represents the energy used for dispersion.

It is assumed that $E_h+E_d \approx 0.1$ E.

Further. E is equal to the sum of the individual compounds. For 1 kg of activated and dispersed water, therefore, E has the following magnitude:

$$E=E_{O+}+E_{O-}+E_{H2}+E_{OH+}+E_{OH-}+E_{H+}+E_{H-}$$

$$E=(0.1666\times16.0\times98114+0.1666\times16\times6344+0.0002\times2.1588\times143000+0.0001\times17.0794\times85943.6+0.0001\times17.0794\times492.8+1.0794\times0.3332\times680236+1.0794\times0.3332\times282801.3)/6.007=129380 \text{ kJ/kg}$$

The values are given by V. S. Stepanov (Chemical energy and exergy of substances, Novosibirsk, Nauka, 1990, page 163ff).

If one further takes into account in the calculations that the energy loss will be 1%, the specific consumption comes to 0.38 g water for 1 kWh, with the rest of the water being recycled. The efficiency of the process depends on the type of engine that is used.

According to experimental results, the specific consumption varies between 0.4 and 2.0 g of water for 1 kWh. Various implementation technologies are found which have the capability of realizing of the possibility of using water in power plants.

Other finely-dispersed activated fluids can be used in a similar manner as water in Example 1. Such other fluids are, for example, aqueous solutions of gases or fluids. The volume expansion and the energy used to activate and disperse the fluid and the energy consumed by the engine/turbine depend on the actuating fluid that is selected.

EXAMPLE 2

Use of Gas Energy Obtained by Dissociation of Clathrates, Gas Hydrates and Metal Hydrides To attain the greatest possible yield by this embodiment form, the power source should be situated in the proximity of a heat source 51 and a cooling source 50. A heat source 51 may be, for example, waste heat from exhaust gases, waste water from industry or other power plants, thermal sources or heating by renewable energy such as solar and wind energy. A cooling source 50 may be, for example, cold water (e.g. from artesian wells, glacial water or the ocean).

FIG. 3 illustrates the principle for a gas hydrate plant and the components necessary for the process. The plant illustrated here uses methane 1 and propane 2 as gases for the formation of gas hydrate. The gases 1, 2 are blended in a mixer 3 and fed through a line 4 to a reactor 21 for gas hydrate formation. Reactor 21 must be cooled by an external cooling source 50 since the reaction is exothermic. Further, water is fed to reactor 21 through line 8 for formation of gas hydrate and to form a mass of water and gas hydrate 31. Water from water container 5 must be pre-processed, according to its quality, to remove disturbing impurities and is therefore first fed via line 6 to the water treatment unit 7 and then conducted via line 8 into reactor 21. The mass 31 formed in reactor 21 is fed into one or more reactors 20 for gas hydrate decomposition. Here the gas hydrate is split and the mixture of water, gas and aqueous vapor 40 thus formed is fed into a separator 22, where the water is removed while the dry gas 41 is fed to a receiver 23 for compressed gas. From here the gas 42 is conducted into a gas heater 24. The heated gas 43 is fed into a turbine 10 as shown in FIG. 3 or into an engine, for example a piston engine. Turbine 10 may, for example, be connected to a generator 11. When the gas has emitted its excess energy to turbine 10, it is fed via line 30 back to reactor 21 for gas hydrate formation. Thus, the consumption of methane 1 and propane 2 will be limited to the start-up of the operation and replacement of loss to the surroundings. Similarly, the water that is separated out in separator 22 may be recycled in reactor 21 for gas hydrate formation. Gas heater 24 and gas hydrate decomposition reactor 20 are heated by means of the external heat source 51 described above. The heat is conducted to decomposition reactor 20 and the gas heater 24 via lines 52 and 53, respectively.

In most cases hydrates are formed from hydrocarbon gas mixtures in a pressure range of 0.5-50 MPa and at temperatures in the range of 273-303 K. The composition of the gas can be adapted to the temperature of the heat source/cooling source that is used. It is advantageous to use gas mixtures that form gas hydrates at temperatures above 0° C. and low pressure.

For a mixture of 85 mole-% of methane and 15 mole-% of propane. Based on the following data it is possible to calculate the energy balance for a process that uses such a mixture:

$\mu_g$=20.25—the molecular mass of the gas mixture;

n=9.42—average number of water molecules in the hydrate;

$\mu_{gh}$=189.9—molecular mass of the hydrate;

R=410.59 J/kgK—gas constant value for the gas mixture;

$\rho_g$=0.91 kg/m$^3$—density of the gas mixture;

$\rho_{gh}$=893.9 kg/m$^3$—density of the gas hydrate:

$T_f$=280.15 K—gas hydrate formation temperature;

$P_f$=0.88 MPa—gas hydrate formation pressure;

$\Delta H_f$=438.6 kJ/kg—gas hydrate formation energy;

$T_{f1}$=270.15 K—water temperature at the entry to the gas hydrate formation reactor at 0.88 MPa;

$T_{f2}$=280.15 K—water temperature at the exit from the gas hydrate formation reactor;

$T_d$=299.15 K—gas hydrate decomposition temperature;

$P_d$=29.28 MPa—gas hydrate decomposition pressure;

$\Delta H_d$=373.7 kJ/kg—gas hydrate decomposition energy at $T=T_d$ and $P=P_d$;

$T_t$=363.15 K—external water temperature at the entry to the heat exchanger;

$T_1$=363.15 K—gas temperature at the entry to the turbine;

$P_1$=29.28 MPa—gas pressure at the entry to the turbine;

$C_{Pg}$=2400 J/kgK—average thermal capacity for the gas mixture;

$C_{P1}$=4200 kJ/kgK—average thermal capacity for water in the temperature range of 280-363 K;

$C_{P2}$=4199 kJ/kgK—average thermal capacity in the temperature range of 270-280 K;

$C_{P3}$=4100 kJ/kgK—water thermal capacity at the pressure of 29.28 MPa;

$C_{Pgh}$=3942 kJ/kgK—gas hydrate thermal capacity at the pressure of 29.28 MPa;

$C_{Vg}$=1989.4 kJ/kgK—gas mixture thermal capacity at a constant volume.

Amount of gas in 1 kg of gas hydrate=0.107 kg.

Volume ratio of gas hydrate and water in the mass=1:1.

The calculation is done under the assumption that we obtain 1 kg of gas mixture ($m_g$=1 kg). The energy balance is the difference between the energy brought into the system by hot water and the energy spent for gas hydrate decomposition, gas heating and engine/turbine work.

To obtain 1 kg of gas it is necessary to decompose 9.35 kg of gas hydrate, with the mass being preliminarily heated up from 280.15 K to 299.15 K. The energy consumption is:

$$E_d=C_{P3}\times m_w\times\Delta T+C_{Pgh}\times m_{gh}\times\Delta T+m_{gh}\times\Delta H_d=4973.4 \text{ kJ.}$$

where the gas hydrate mass $m_{gh}$=9.35 kg and the water mass $m_w$=10 kg.

The energy required to heat the gas from 299.15 to 363.15 K before it is fed into the turbine:

$$E_h=C_{Pg}\times\Delta T\times m_g=153 \text{ kJ}$$

Total consumption of energy from the hot water source: 5126 kJ.

Energy released in reactor during the formation of gas hydrate from 1 kg of gas:

$$E_f=m_{gh}\times\Delta H_f=4101 \text{ kJ}$$

To obtain energy for decomposition of gas hydrate and heating of the gas it is required to have 19 kg of water at a temperature of 363.15 K, which is passed through one or more heat exchangers.

The energy released in the hydrate formation reactor goes partially for heating of the mass from 270 to 280 K (778 kJ), and the other part (3307 kJ) is removed by cold (277 K) water. To cool the reactor down to 280 K it is necessary for 263 kg of water to pass through the heat-exchange system.

The energy of 1 kg of gas may be found by the following formula:

$$E_1=x^{-1}RT_1\{1-[P_2/P_1]^x\}=393.5 \text{ kJ.}$$

where x=(k−1)/k. k=$C_{Pg}/C_{Vg}$=1.206 and the gas pressure at the exit from the turbine $P_2=P_f$=0.88 MPa.

The efficiency of the process is the ratio between the gas energy and the total consumption of energy from hot water, since it is only water that takes part in the work:

$$\eta=(393.5/5126)\times100\%=7.7\%$$

The integrated efficiency of the whole process, taking into account the energy loss for cooling of the gas hydrate formation reactor, is:

$$\eta=(393.5/8433)\times100\%=4.7\%$$

The specific water consumption will be the following:

Hot water=48.3 kg/MJ

Cold water=667.8 kg/MJ

The efficiency of the process naturally depends on the hot water or other heat carrier temperature.

In addition to the gas hydrates formed from hydrocarbons or a mixture thereof, as described herein, a number of other gases may be used in similar processes. Such gases are, for example, rare gases, $CO_2$, other hydrocarbon gases, Freon, nitrogen, and many others.

Also, a process similar to the one described in Example 2 may be employed for the utilization of metal hydrides, for example $MgH_2$ as actuating agent. Magnesium hydride is formed from magnesium and transition metal alloys at temperatures of 420-450 K and a pressure of 1-5 MPa. The reaction is reversible. Released hydrogen is fed into a turbine or into a cylinder of an engine. A plant of this type consequently requires a storage tank for hydrogen.

EXAMPLE 3

Catalytic Dissociation of a 70-80% Solution of Hydrogen Peroxide

On FIG. 4 is shown an outline of a possible embodiment of a power source driven by dissociation of hydrogen peroxide. The plant comprises a line 40 for the injection of a solution or vapor form of $H_2O_2$ from an $H_2O_2$-reservoir 22 into a reaction chamber of a turbine 10 or an engine, in which a catalyst is placed. To turbine 10 there may be connected a generator 11. $H_2O_2$ dissociates by the following reaction:

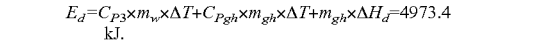

$$H_2O_2\rightarrow H_2O+\tfrac{1}{2}O_2+149.8 \text{ kJ}$$

The volume of the resulting vapor and the oxygen is approximately 6000 times greater than the volume of the injected $H_2O_2$, and the temperature rises to 973-1023 K. When a turbine 10 is used, the reaction chamber may be separated from it (not shown) and the mixture must consequently be conducted into turbine 10. The waste gas 30 from the turbine/engine is fed into a regeneration reactor 20 containing $BaO_2$, where $CO_2$ is added. Regeneration of $H_2O_2$ and $BaO_2$ proceeds according to the following reactions:

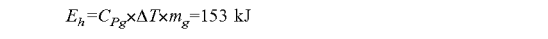

$$BaO_2+CO_2+H_2O\rightarrow BaCO_3+H_2O_2$$

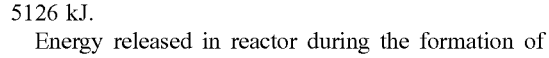

$$BaCO_3\rightarrow BaO+CO_2$$

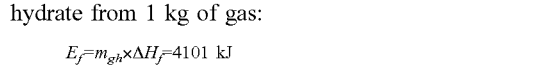

$$BaO+\tfrac{1}{2}O_2\rightarrow BaO_2$$

Hydrogen peroxide is extracted by water and is led out of reactor 20 via pipeline 42 to a distillation column 21, where the hydrogen peroxide is concentrated for subsequent use as an actuating fluid and is conducted via line 41 to reservoir 22. The residual heat from exhaust gas 30 can be used to carry out the distillation. Connected to reactor 20 is a device 23 for regeneration of $BaO_2$. Regenerated $BaO_2$ is conducted by line 24 to a receiver for $BaO_2$, and from here a line 25 leads back to reactor 20, as needed.

$BaO_2$ is also regenerated according to the reactions above. The formation of hydrogen peroxide through the use of barium oxide and the regeneration thereof are known, inter alia, from DE 179771 and DE 460030, as given by Walter C. Schumb et al., "Hydrogen Peroxide", Reinhold Publishing Corp., New York, 1955. It is entirely possible to use other compounds to re-form hydrogen peroxide and to regenerate these in a similar manner, for example 2-alkylanthrahydroquinone; see DE 2228949, U.S. Pat. No. 2,966,397, DE 355866 and DE 179826.

The process exemplified herein theoretically uses only water and oxygen that are supplied via lines 26 and 28 from the oxygen and water tank, respectively. In practice there will also be some consumption of carbon dioxide, since $CO_2$ is dissolved in the water that is evaporated, and $CO_2$ is supplied via line 27 from the $CO_2$ tank. The supplying of oxygen can be accomplished by bringing in atmospheric air.

Energy Balance of the Process:

The calculation is based on a 70% solution of $H_2O_2$. The energy that is emitted includes, first, the energy from the catalytic dissociation of $H_2O_2$, which is equal to 2785.4 kJ/kg according to V. S. Stepanov, "Chemical energy and exergy of substances", Novosibirsk, Nauka, 1990, page 163 ff; and secondly, the energy from the catalytic exothermic reaction on the formation of $BaO_2$ in the solution, which is equal to 1623 kJ/kg. The energy consumption consists of energy expended for work of the engine/turbine and the distillation column. The calculation is done for 1 kg $H_2O_2$. The following data are used as a basis:

$H_2O_2$ concentration in the regeneration reactor=25%;

$H_2O_2$ yield=90% of the theoretical quantity;

$C_{P1}$=4200 J/kgK—water thermal capacity;

$C_{P2}$=2630 J/kgK—$H_2O_2$ thermal capacity;

$C_{P3}$=2344 J/kgK—thermal capacity of the gas mixture at 1100 K;

$C_V$=1868.6 J/kgK—thermal capacity of the gas mixture at a constant volume;

R=475.4 J/kgK—gas constant for the gas mixture:

T=1100 K—gas mixture temperature at the beginning of the process;

$k=C_{P3}/C_V=1.254$;

μ=17.488—gas mixture molecular mass;

$\Delta H_{evap}$=2258 kJ/kg—water evaporation energy at 333 K;

$E_n$=4430 kJ/kg—energy consumed in concentrating $H_2O_2$ to 70%;

There is required 0.37 kg $H_2O$, 0.33 kg $O_2$ and 0.9 kg $CO_2$ for the production of 1 kg of a 70% solution of $H_2O_2$. The amount of $BaO_2$ that takes part in the reaction is 3.44 kg, and the amount of energy released during $BaO_2$ formation is 5583 kJ. The remaining 1153 kJ is used to heat up the $H_2O_2$ solution before it is fed into the reaction chamber of a turbine/engine and for heating the equipment. The energy from the $H_2O_2$ dissociation is equal to 1546.5 kJ. The process efficiency η=56.2%.

EXAMPLE 4

Utilization of Thermal Process in Formation of Methane from Carbon Monoxide and Hydrogen On FIG. 5 is shown an outline of a plant adapted to an embodiment of the method according to the invention, where the actuating fluid is carbon monoxide and hydrogen that are converted to methane and water. Such a plant could preferably be built in the proximity of a nuclear power plant or another facility with high-temperature gas-cooled reactors. The heat from these reactors is used for methane conversion. In this example, methane is used, but it is entirely possible to utilize other hydrocarbon gases in similar processes. The methane is converted together with water in a layer of boiling catalyst in a reactor 20 heated by the external heat source 50. Through this reaction there are formed mainly carbon monoxide, CO and hydrogen, $H_2$. These gases 40 are conducted into a reaction chamber 21 where the following catalytic exothermic reaction takes place:

$$CO+3H_2 \rightarrow CH_4+H_2O+206.4\ kJ$$

By this reaction 28 g CO and 6 g $H_2$ are converted to 16 g $CH_4$ and 18 g water vapor. When the methane-steam mixture leaves reaction chamber 21, it has a temperature of 900 K and a pressure of 5 MPa. This hot gas mixture is conducted via line 41 into a turbine 10 as actuating fluid. The turbine may be connected to a generator 11. The gas 30 leaving turbine 10 is fed into reactor 20 and is converted again. The tanks of CO and $H_2$ shown in FIG. 5 are used to start-up the system, while oxygen and methane are used to cover any possible loss.

The optimal $H_2O$ to $CH_4$ ratio is 3-4:1 at a conversion level of 0.99, if the process is carried out at an entry pressure of 3-5 MPa and a temperature of 1100 K. More details concerning this are described in V. A. Legasov et al., "Nuclear-hydrogen power engineering and technology," Moscow, Atomisdat, 1978, pages 11-36.

Energy Balance of the Process:

The amount of energy released during the catalytic reaction between CO and $H_2$ is equal to 206.4 kJ/mole.

T=900 K—starting temperature for the process;

$P_1$=5 MPa—starting pressure for the process;

$P_2$=0.11 MPa—ending pressure for the process;

μ=17.03—molecular mass of the gas mixture;

R=488.2 J/kg—gas constant;

$C_{P1}$=69.14 J/moleK—thermal capacity of $CH_4$ at 900 K;

$C_{P2}$=40.26 J/moleK—thermal capacity of $H_2O$ at 900 K;

$C_P$=53.83 J/moleK—thermal capacity of the gas mixture at a constant pressure;

$C_V$=2672.7 J/kgK—thermal capacity of the gas mixture at a constant volume;

$k=C_P/C_V=1.183$;

ΔH=12120 kJ/kg—the reaction energy;

The work carried out by 1 kg of gas mixture:

$E=x^{-1}\ RT\ [1-[P_2/P_1]^x]=1270$ kJ, where $x=(k-1)/k$

The process efficiency $\eta=(1272.7/12120)\times 100\%=10.48\%$.

There are other ways of realizing the utilization of CO and H2 as actuating fluids. The choice of method depends on the availability of natural or industrial resources in the region where the plant is to be installed.

The difference between the method according to the invention and the standard method of utilizing hydrocarbons is that, in addition to using the reaction energy, the reaction products are also used as actuating fluid for turbine operation. In a conventional method the reaction energy is used to heat up water in order to make steam that is used as an actuating fluid in a turbine.

The method exemplified herein may also be installed near a chemical plant that utilizes the conversion products for the purpose of synthesis. The methane produced may in that case be used wholly or partially as raw material instead of being recycled.

The invention claimed is:

1. A method for the production of mechanical energy from an energy producing unit, comprising feeding a working fluid to an energy producing unit, where the working fluid before entering or within the energy producing unit employs an external energy source to undergo a dissociation and/or chemical reaction causing a direct and/or indirect volume expansion of the working fluid which volume expansion drives the energy producing unit, and wherein the working fluid exiting the energy producing unit is conducted further to a recycling unit, where the working fluid is converted to its initial non-dissociated and/or chemically reacted state before being re-directed to the energy producing unit.

2. The method according to claim 1, wherein the working fluid consists of any gas or a gas mixture or a gas-vapour mixture.

3. The method according to claim 2, wherein the working fluid is activated, finely-dispersed, partly dissociated water.

4. The method according to claim 3, wherein the working fluid exiting the energy producing unit, after being cooled turns consecutively into steam and then into source water for regenerating the working fluid.

5. The method according to claim 1, wherein the working fluid is gas hydrates, metal hydrides, fixed gases or low-boiling liquids vapour.

6. The method according to claim 5, wherein said dissociation and/or chemical reaction converts the working fluid to consist of gases obtained by gas hydrate melting, by metal hydride decomposition or by desorption.

7. The method according to claim 1, wherein the working fluid is hydrogen peroxide or its water solution.

8. The method according to claim 7, wherein hydrogen peroxide is fed into the energy producing unit, said reaction is a catalytic decomposition of hydrogen peroxide into a mixture of gases $H_2$0 and $O_2$, and the working fluid exiting the energy producing unit is converted into hydrogen peroxide to be fed back to said energy producing unit.

9. The method according to claim 8, including reacting the working fluid with $BaO_2$ and $CO_2$ producing hydrogen peroxide and $BaCO_3$, and converting the thus formed $BaCO_3$ to $BaO_2$.

10. The method according to claim 1, wherein the working fluid is a mixture of $H_2$ and CO.

11. The method according to claim 10, wherein said reaction comprises bringing the mixture of $H_2$ and CO in contact with a catalyst that exothermally converts $H_2$ and CO into a mixture of $CH_4$ and water vapour, and wherein the working fluid exiting the energy producing unit is converted into $H_2$ and CO under the influence of an external or internal heat source.

12. A method for the production of mechanical energy from an energy producing unit, comprising creating a hot actuating fluid by adding water that has been at least partly dissociated and ionized to a gas or gas mixture, letting the actuating fluid expand, cool and the ions recombine in said unit, thereby creating said mechanical energy, and condensing an output fluid from said unit thereby producing water.

13. A method for the production of mechanical energy from an energy producing unit, comprising feeding a solution of hydrogen peroxide or hydrogen peroxide steam to an energy producing unit, where the hydrogen peroxide is split into oxygen and water steam in the presence of a catalyst, which causes a volume increase and a temperature rise that drives the energy producing unit, and conducting the oxygen and water from the unit to a reactor where the hydrogen peroxide is regenerated.

14. A method according to claim 13, wherein the hydrogen peroxide is regenerated by reaction with $BaO_2$ and $CO_2$, and the $BaCO_3$ thus formed is converted to $BaO_2$.

15. A method for the production of mechanical energy from an energy producing unit, comprising feeding an input fluid comprising $H_2$ and CO to a reaction chamber having a catalyst for the formation of methane and water, conducting the fluid containing methane and water from the reaction chamber to an energy producing unit, where the fluid drives the energy producing unit, and conducting an output fluid from the energy producing unit on to a reactor, where the output fluid is converted into the input fluid.

* * * * *